United States Patent [19]

Fujii et al.

[11] Patent Number: 4,870,255

[45] Date of Patent: Sep. 26, 1989

[54] INFRARED RAY HEATING APPLIANCE UTILIZING A CONVECTION FAN

[75] Inventors: Masanobu Fujii, Yao; Tatsuya Tsuda, Osaka, both of Japan

[73] Assignee: Sharp Kabushiki Kaisha, Osaka, Japan

[21] Appl. No.: 261,903

[22] Filed: Oct. 25, 1988

Related U.S. Application Data

[60] Division of Ser. No. 134,551, Dec. 15, 1987, Pat. No. 4,803,324, which is a continuation of Ser. No. 828,897, Feb. 13, 1986, abandoned.

[30] Foreign Application Priority Data

Feb. 15, 1985 [JP] Japan ..... 60-20624[U]
Mar. 15, 1985 [JP] Japan ..... 60-38013[U]

[51] Int. Cl.[4] ..... H05B 6/64

[52] U.S. Cl. ..... 219/400; 219/365; 219/10.55 R; 219/10.55 E

[58] Field of Search ..... 219/400, 401, 341, 365, 219/354, 345, 339, 347, 10.55 E, 10.55 B, 10.55 R

[56] References Cited

U.S. PATENT DOCUMENTS

| | | | |
|---|---|---|---|
| 3,731,037 | 5/1973 | Levinson | 219/10.55 E |
| 3,783,220 | 1/1974 | Tanizaki | 219/10.55 E |
| 3,792,230 | 2/1974 | Ray | 219/354 |
| 3,820,525 | 6/1974 | Pond | 219/400 X |
| 3,879,164 | 4/1975 | Haldopoulos et al. | 219/354 |
| 4,052,593 | 10/1977 | Ebert | 219/354 |
| 4,190,757 | 2/1980 | Turpin et al. | 219/10.55 E |
| 4,434,344 | 2/1984 | Dills | 219/10.55 E |
| 4,453,064 | 6/1984 | Toyoda et al. | 219/10.55 E |
| 4,771,154 | 9/1988 | Bell et al. | 219/10.55 B |

*Primary Examiner*—Philip H. Leung

[57] ABSTRACT

A heating appliance including a heat source for heating air, a convection fan for blowing the heated air into a heating chamber, and an infrared radiator disposed in the path of the heated air.

8 Claims, 5 Drawing Sheets

INFRARED RAY HEATING APPLIANCE UTILIZING A CONVECTION FAN

This application is a divisional of copending application Ser. No. 07/134,551, filed on Dec. 15, 1987, U.S. Pat. No. 4,803,324 which is a continuation of application Ser. No. 06/828,897 filed on Feb. 13, 1986, now abandoned.

BACKGROUND OF THE INVENTION

The present invention relates to a heat appliance such as a microwave oven, a convection cooking apparatus, etc. and, more particularly, to a heating appliance which heats a food by infrared rays, especially, far-infrared rays.

In a microwave oven, although a heating period can be reduced because microwaves have large energy, a food may be unevenly heated because a wave length of the microwaves is long. In a convection heating appliance, heat from a convection heating means may not be introduced into the interior of the food, so that the food may be uniformly heated.

SUMMARY OF THE INVENTION

Accordingly, it is an object of the present invention to provide a heating appliance which prevents a food from unevenly heating and can reduce a heating period of time.

It is another object of the present invention to provide a heating appliance which uniformly or evenly heats a food by using an infrared ray heating, especially, a far-infrared ray heating.

It is still another object of the present invention to provide an infrared ray heating appliance which uniformly heats the interior and the exterior of a food with the reduction of the energy loss.

It is a further object of the present invention to provide a far-infrared ray heating appliance which includes a far-infrared radiator board radiating far-infrared rays by receiving energy from a heating source.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

To achieve the above objects, according to an embodiment of the present invention, a heating appliance comprises first heating means for heating an object, and second heating means for heating the object in response to the operation of the first heating means by receiving energy from the first heating means and by radiating infrared rays.

The second heating means may include heat radiating means for radiating heat by energy from the first heating means, and infrared radiating means for radiating infrared rays by the heat from the heat radiating means. The heating appliance may include means for filtering far-infrared rays among the infrared rays.

To achieve the above objects, according to another embodiment of the present invention, a heating appliance comprises means for generating microwaves, and heating means for heating an object by receiving the microwaves in addition to the microwave heating, the heating means comprises means for absorbing the microwaves, means for radiating heat according to the amount of the microwaves, and infrared radiating means, disposed on the heat radiating means, for radiating infrared rays according to the heat from the heat radiating means.

The heating appliance may include means for filtering far-infrared rays among the infrared rays. A microwave passing hole may be provided with the heating means.

To achieve the above objects, according to still another embodiment of the present invention, a heating appliance comprises heater means for heating air, convection fan means for blowing the heated air into a heating chamber, and infrared radiating means disposed on the path of the heated air the infrared radiating means comprising means for collecting heated from the heat air, heat radiating means for radiating heat according to the heat of the heat collecting means, and infrared ray radiating means for radiating infrared rays in response to the heat of the heat radiating means.

The heating appliance may include means for filtering far-infrared rays among the infrared rays.

The far-infrared radiating means may be detachably provided in the heating chamber. The infrared radiating means may be curved.

BRIEF DESCRIPTION OF THE DRAWINGS

The present invention will be better understood from the detailed description given hereinbelow and the accompanying drawings which are given by way of illustration only, and thus are not limitative of the present invention and wherein:

FIG. 1(*b*) shows a plan view of a heating plate used in the heating appliance of FIG. 1(*a*);

FIG. 1(*c*) shows a sectioanl view of the heating plate of FIG. 1(*b*);

FIG. 2(*b*) shows a sectional view of a heating plate used in the heating appliance of FIG. 2;

DETAILED DESCRIPTION OF THE PREFERRED EMBODIMENTS

The embodiments of the present invention applied to a microwave oven and a convection heating apparatus will be described below. The present invention should not be limited to microwave oven and convection heating apparatus. The present invention may be applied to a device including means for applying energy to be radiated infrared rays from an infrared ray radiating member. In the present invention, infrared ray heating is carried out in addition to the microwave heating or the convection heating, etc. A food is uniformly heated by the infrared rays because the wave-length of far-infrared rays in the infrared rays is shorter. Also, the interior of the food is efficiently heated by the infrared rays.

Figure 1A:
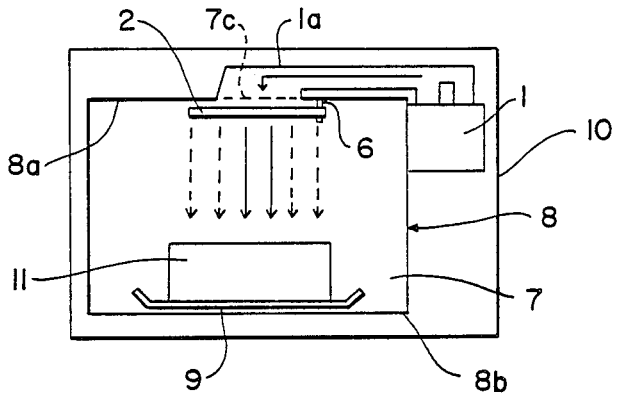
FIG. 1(*a*) shows a sectional view of a heating appliance according to a first embodiment of the present invention.
Figure 1B:
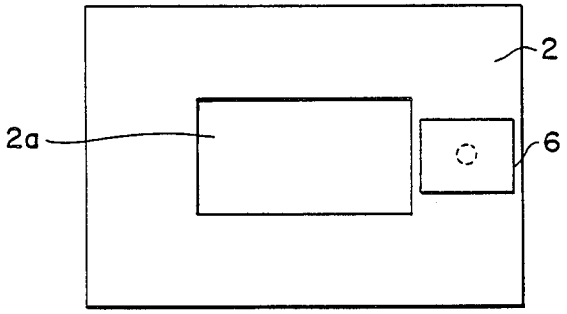
Figure 1C:
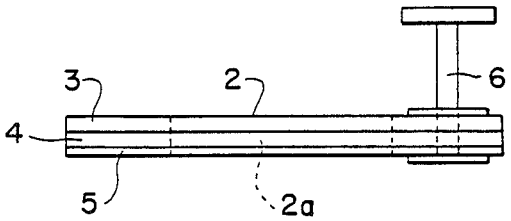

A first embodiment of the present invention applied to the microwave oven will be described below with reference to FIGS. 1(*a*) and FIG. 1(*c*). An infrared ray heating type microwave oven comprises an oven housing 10 including a heating chamber 7, a microwave generator 1 including a magnetron, a waveguide 1*a* for introducing microwaves from the microwave generator 1 into the heating chamber 7, and a heating plate 2 which is heated by the microwaves from the microwave generator 1 and which functions as an infrared ray radiator. A table 9 is provided in the heating chamber 7 for disposing-food 11 to be heated. The table 9 may be a turntable.

The heating plate 2 comprises a heat radiating plate 3, for example, made of a ferrite material, for absorbing the microwaves from the microwave generator 1 and radiating heat, an infrared radiator 4 layered on the heat radiating plate 3, for example, made of a ceramic material, for radiating infrared rays by the heating of the conduction heat from the heat radiating plate 3, a far-infrared ray filtering member 5 layered on the infrared ray radiator 4, for filtering or passing far-infrared rays among the infrared rays produced from the infrared radiator 4. An opening 2*a* for passing the microwaves is formed at the substantially center portion of the heating plate 2.

The material of the heating plate 2 is a Fe-Ni-Al type alloy member, a ceramic member layered on the alloy member, and a silicon type metal, having a high transmission frequency range, layered on the ceramic member. The Fe-Ni-Al alloy member having a relatively high electromagnetic wave absorption factor and a relatively high heating value is provided as the heat radiating plate 3. The ceramic member having a relatively high infrared ray radiation factor is provided as the infrared ray radiator 4. The silicon type metal reflecting near-infrared rays, having much heat, among the infrared rays and passing the far-infrared rays used for a uniformly heating is provided as the far-infrared ray filtering member 5.

The heating plate 2 is fixed to an upper wall 8*a* of the heating chamber 7 by a connecting member 6. The heating plate 2 may be detachably provided in the heating chamber 7 so that the microwaves are applied to the heat radiating plate 3 of the heating plate 2. Therefore, the heat radiating plate 3 is faced with a microwave introducing portion 7*c*. The table 9 is disposed on a bottom wall 8*b* of the heating chamber 7. Food 11 to be heated is disposed on the table 9. The microwave generator 1 is provided at the outside and upper portion of the side wall 8 of the heating chamber 7. One end of the waveguide 1*a* is connected to the microwave generator 1, and the other end of the waveguide 1*a* is securely connected to the peripheral portion of the microwave introducing portion 7*c* of the upper wall 8*a* of the heating chamber 7. The microwave introducing portion 7*c* has a plurality of punched holes.

In the above construction, when heating, the microwaves produced from the microwave generator 1 are applied into the heating chamber 7 from the microwave introducing portion 7*c* through the waveguide 1*a*. A part of the microwaves is applied to the surface of the heat radiating member 3 of the heating plate 2. The remaining microwaves are applied to the food 11 to be heated through the microwave passing opening 2*a* or by reflecting by the walls of the heating chamber 7. The microwaves applied to the heat radiating member 3 of the heating plate 2 are absorbed by the heat radiating plate 3 so that the heat radiating plate 3 starts to radiate heat. The heat from the heat radiating plate 3 is introduced to the infrared ray radiator 4. The infrared ray radiator 4 is red-heated so that the infrared ray radiator 4 starts to radiate the infrared rays. The far-infrared rays are passed by the far-infrared ray filtering member 5. The near-infrared rays are reflected by the far-infrared ray filtering member 5. In this case, both the microwaves and the far-infrared rays are applied to the food, so that the food can be uniformly heated by both the microwaves and the far-infrared rays within a relatively short period. As both the microwave heating and the far-infrared heating are a radiant type heating operation, the energy loss may be reduced in comparison with the convection heating or a heat transfer heating. Therefore, the heat energy penetrates into the interior of the food so as to heat the food. The food can be uniformly heated because the temperature difference between the exterior and the interior of the food becomes lower.

Figure 2A:
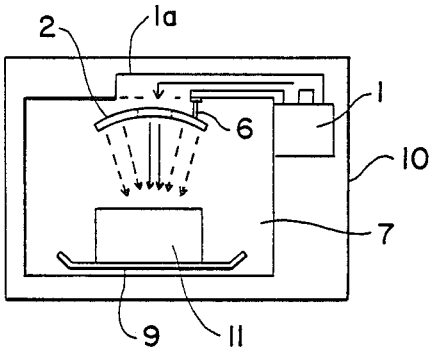
FIG. 2(*a*) shows a sectional view of a heating appliance according to a second embodiment of the present invention.
Figure 2B:
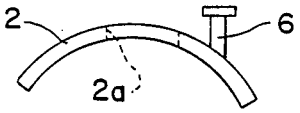

A second embodiment of the present invention will be described below with reference to FIGS. 2(*a*) and 2(*b*). In the second embodiment, the heating plate 2 is bent or curved in a round shape so that the far-infrared rays produced from the heating plate 2 are concentrated on the food 11 by the curved surface of the heating plate 2. In FIGS. 2(*a*) and 2(*c*), components common to FIGS. 1(*a*) and 1(*b*) are given the same reference numbers.

Figure 3:
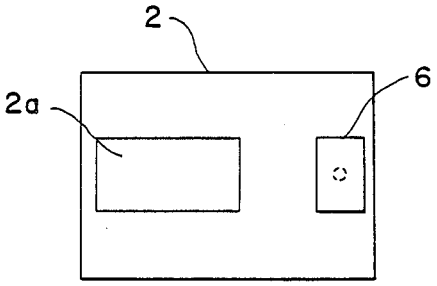
FIG. 3 shows a plan view of the heating plate when the position of a microwave passing hole is changed.
Figure 4A:
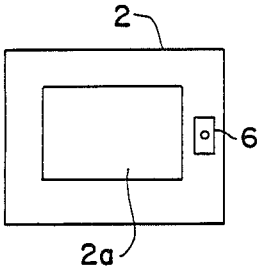
FIGS. 4(*a*), 4(*b*), and 4(*c*) show plan views of the heating plate when the shape of the microwave passing hole is changed, respectively.
Figure 4B:
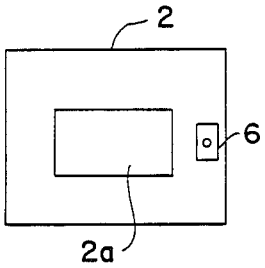
Figure 4C:
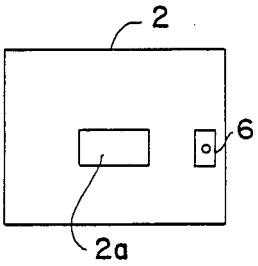
Figure 5A:
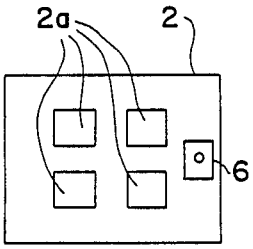
FIGS. 5(*a*), 5(*b*), and 5(*c*) show plan views of the heating plate when the number of the microwave passing holes are changed.
Figure 5B:
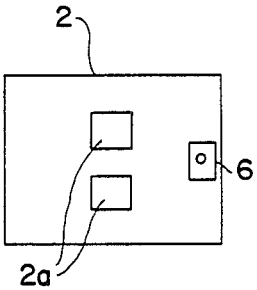
Figure 5C:
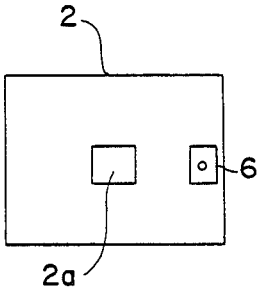

In the first and second embodiments, the opening 2*a* for introducing the microwaves into the heating chamber 7 is varied as shown in FIGS. 3, and 4(*a*) through 4(*c*). As shown in FIG. 3, the opening 2*a* may be eccentrically provided. As shown in FIGS. 4(*a*) through 4(*c*), the size of the opening 2 may be changed. The heating characteristic can be selected by changing the size of the opening 2*a*. For example, if the size of the opening 2*a* becomes greater, the heating characteristic becomes near to the microwave heating. If the size of the opening 2*a* becomes smaller, the heating characteristic becomes near to the far-infrared heating. As shown in FIGS. 5(*a*) thorugh 5(*c*), the number of the openings 2*a* may be increased or decreased. The heating characteristic is, also, selected by changing the number of the openings 2*a*.

As described above, the heating operation of the present invention uses the microwaves and the far-infrared rays at the same time. Also, the heating amount or the heating characteristic is controlled by changing the size of the opening 2*a* or the number of the openings 2*a*. Therefore, the heating of the present invention prevents the object from being unevenly heated and can reduce the heating period of time.

Because the radiation of the far-infrared rays is carried out by the heating plate 2 which includes the far-infrared ray filtering member, etc. without using an additional member such as a sheathe heater, wirings are not increased and the power of a power source is not increased in comparison with the conventional microwave oven. Also, since only the heating plate 2 is used for the radiation of the infrared rays, the present invention can be applied to the conventional microwave oven.

As described above, a heating appliance comprises the microwave generator, the heating plate heating by the microwaves from the microwave generator through the waveguide. The heating plate comprises the heat radiating plate for absorbing the microwaves from the microwave generator and for producing the heat, the infrared radiator layered on the heat radiating plate, for radiating the infrared rays by the heating of the conduction heat from the heat radiating plate. The opening for passing the microwaves may be formed on the heating plate.

In the above embodiments, the far-infrared ray filtering member 5 may be eliminated so that the food is heated by the infrared rays including the far-infrared rays. Also, the heating plate 2 may be detachably provided on the upper wall 8*a* of the heating chamber 7 or in the heating chamber 7. The height of the heating plate 2 may be freely changed by using a height control pin (not shown) provided at the connection between the connecting plate 6 and the heating plate 2 for controlling the height of the heating plate 2. The heating plate 2 may be disposed such that the microwaves are applied to the heat radiating plate of the heating plate.

Third and fourth embodiments of the present invention applied to the convection heating appliance will be described below with reference to FIGS. 6 through 10.

Figure 6:
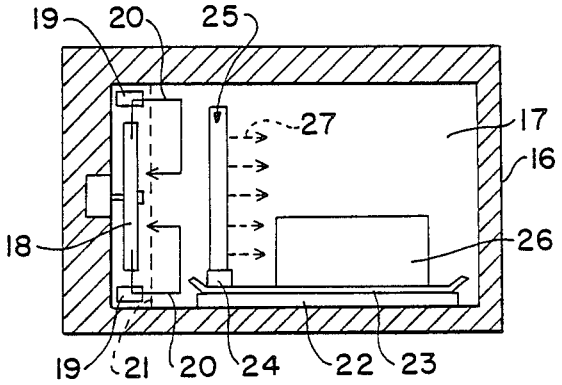
FIG. 6 shows a sectional view of a heating appliance according to a third embodiment of the present invention.

In FIG. 6, an infrared ray heating appliance 16 comprises an oven housing including an oven cavity (or a heating chamber) 17, a convection fan 18, heaters 19 and 19, and a heating plate 25 which functions as a far-infrared ray radiation board. The convection fan 18 is provided in the oven housing for blowing heated air 20 into the heating chamber 17. The heaters 19 and 19 are provided under and over the convection fan 18, respectively. A convection fan protection cover 21 is provided at or adjacent the front of the convection fan 18 for protecting the convection fan 18 and dividing the heating chamber 17 and the convection fan portion. A cooking dish seat portion 22 is provided on the bottom wall of the heating chamber 17. A cooking dish 23 is disposed on the cooking dish seat portion 22 for carrying a food to be heated. The heating plate 25 is provided on the end of the cooking dish 23 opposite to the convection fan 18. A fixed base 24 is provided at the end of the heating plate 25 for fixing the heating plate 25 on the cooking dish 23. The food 26 to be heated is disposed on the cooking dish 23 in front of the heating plate 25. The heating plate 25 may be integrally connected to the cooking dish 23, or may be detachably disposed on the cooking dish 23 so that the spaces between the convection fan 18 and the heating plate 25 or between the food 26 and heating plate 25 are changed.

Figure 7:
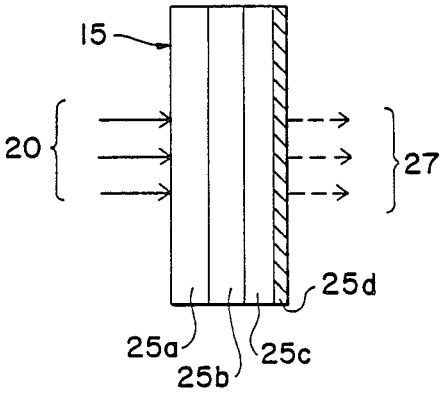
FIG. 7 shows a sectional view of a far-infrared ray radiating board used in the heating appliance of FIG. 6.

As shown in FIG. 7, the heating plate 25 comprises a heat collecting plate 25*a*, a heat radiation plate 25*b*, a ceramic plate 25*c*, and an infrared ray radiation plate 25*d*. The members 25*a*, 25*b*, 25*c*, and 25*d* are successively layered on each other. The heat collecting plate 25*a* is disposed to receive heated air from the convection fan 18. The far-infrared ray radiating plate 25*d* is opposite to the food 26. When the heated air from the convection fan 18 is, first, applied to the heat collecting plate 25*a*, far-infrared rays 27 are radiated from the far-infrared radiating plate 25*d*.

Figure 8:
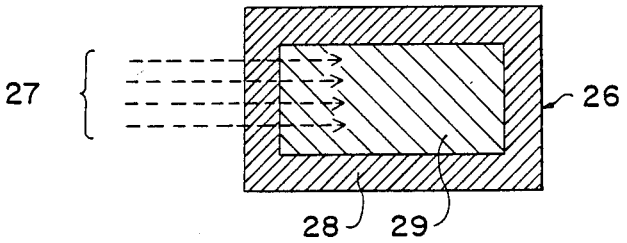
FIG. 8 shows a sectional view of a food heated by the heating appliance of the present invention.

In the above construction, air heated by the heaters 19 is blown by the convection fan 18. The blown heated air 20 is applied to the heat collecting plate 25*a*, and the heat of the heated air 20 is absorbed by the heat collecting plate 25*a*. The heat collected by the heat collecting plate 25*a* is conducted to the heat radiation plate 25*b*. The heat radiation plate 25*b* radiates the heat. The ceramic plate 25*c* is heated and radiates the infrared rays by the heat from the heat radiation plate 25*b*. The heat (or the infrared rays) of the ceramic plate 25*c* is conducted to the far-infrared radiation plate 25*d*, so that the far-infrared rays 27 are radiated from the far-infrared radiation plate 25*d*. The far-infrared rays 27 are passed through the far-infrared radiation plate 25*d* and applied to the food 26. The far-infrared ray radiation plate 25 functions as a far-infrared filtering member such that the near-infrared rays are reflected by the far-infrared ray filtering plate 25*d* and the far-infrared rays 27 are passed through the far-infrared ray radiation plate 25. The far-infrared rays 27 radiated by the above ways are applied to the food 26 disposed in front of the heating plate 25 so that the food 26 is heated. In this case, as shown in FIG. 8, the far-infrared rays 27 are conducted into and heat the interior 29 of the food 26. Therefore, both the exterior and the interior 29 of the food 26 are uniformly heated by reducing the temperature difference between the exterior 28 and the interior 29 of the food.

Figure 9:
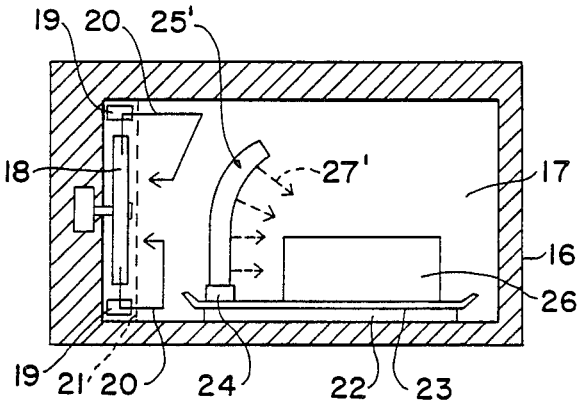
FIG. 9 shows a sectional view of a heating appliance according to a fourth embodiment of the present invention.
Figure 10A:
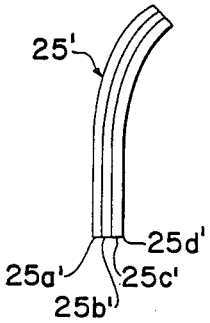
FIGS. 10(*a*) and 10(*b*) show an enlarged sectional view and an enlarged front view of a far-infrared ray radiating board used in the heating appliance of FIG. 9, respectively.
Figure 10B:
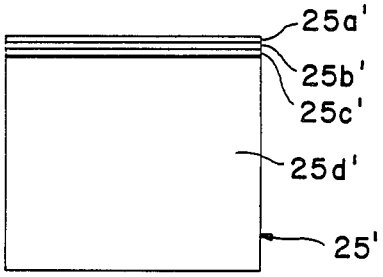

The fourth embodiment of the present invention will be described below with reference to FIGS. 9, 10(*a*) and 10(*b*).

In the fourth embodiment, the shape of the far-infrared radiation board 25 used in the third embodiment is changed. As shown in FIG. 10, the components of the far-infrared radiation board 25' are as same as the components of the far-infrared ray radiation board 25 of the third embodiment. The top portion of the far-infrared radiation board 25' is curved so that the far-infrared ray radiation board 25' is formed in a round form, namely, in a centriperal curved form. The far-infrared radiation plate 25*d'* is faced in the direction of the center of the food 26. As shown in FIG. 9, the far-infrared ray radiation board 25' is disposed on the cooking dish 23 of the heating chamber 17. The center of the circle formed by the inside surface of the board 25' is substantially equal to the center of the food 26.

The heated air 20 is applied to the back surface of the far-infrared ray radiation board 25' by the convection fan 18. The heat is conducted to the far-infrared radiation plate 25*d'* through the heat collecting plate 25*a'*, the heat radiation plate 25*b'*, and the ceramic plate 25*c'*. The far-infrared rays 27 are radiated from the front surface of the far-infrared radiation plate 25*d'*. As shown in FIG. 8, the interior 29 and the exterior 28 of the food 26 are uniformly heated by the far-infrared rays in addition to the convection heating. As the far-infrared ray radiation board 25' is curved in the centriperal form, the far-infrared rays 27 are concentrated and radiated toward the food 26. Accordingly the food 26 is efficiently heated.

As described above, the far-infrared ray heating type heating appliance can be applied by the combination of the far-infrared ray radiation board and the convection heating appliance without additional wirings and the additional arrangement.

In the third and fourth embodiments, the food 26 may be heated by the infrared rays produced from the ceramic plate 25*c* or 25*c'*, so that the far-infrared ray radiation plate 25*d* or 25*d'* may be eliminated.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A heating appliance comprising a housing having a heating chamber therein, heater means located in said heating chamber for heating air, infrared radiating means located in said heating chamber, convection fan means for blowing air heated by said heater means onto said infrared radiating means, means for supporting an object in said heating chamber, said infrared radiating means radiating infrared rays toward the object in response to being heated, and said infrared radiating means being made up of a collection portion for collecting heat from the heated air, a heat radiation portion receiving conducted heat from said collecting portion, and an infrared ray radiation portion radiating infrared rays in response to the heat from the heat radiation portion.

2. The heating appliance of claim 1 wherein said infrared radiating means is detachably provided in said heating chamber.

3. The heating appliance of claim 1 wherein said infrared radiating means is curved.

4. The heating appliance of claim 1 wherein said infrared radiating means also includes means for filtering far-infrared rays among the infrared rays.

5. The heating appliance of claim 4 wherein said means for filtering far-infrared rays among the infrared rays is a plate made of silicon type metal.

6. The heating appliance of claim 1 wherein said collection portion of said infrared radiating means is a heat collecting plate.

7. The heating appliance of claim 1 wherein said heat radiation portion of said infrared radiating means is a heat radiation plate made of a ferrite material.

8. The heating appliance of claim 1 wherein said infrared ray radiation portion of said infrared radiating means is a ceramic plate.

* * * * *